US005624170A

United States Patent [19]

Hasty

[11] Patent Number: 5,624,170

[45] Date of Patent: Apr. 29, 1997

[54] QUICK CONNECT AND DISCONNECT DOOR AND HINGE APPARATUS

[75] Inventor: Robert K. Hasty, Union, Ky.

[73] Assignee: NuTone Inc., Cincinnati, Ohio

[21] Appl. No.: 637,863

[22] Filed: Apr. 25, 1996

[51] Int. Cl.[6] ..... A47B 88/00

[52] U.S. Cl. ..... 312/329; 16/382; 49/381

[58] Field of Search ..... 49/381; 312/227, 312/264, 257.1, 329; 16/270, 271, 272, 382

[56] References Cited

U.S. PATENT DOCUMENTS

| | | | |
|---|---|---|---|
| 188,402 | 3/1877 | Palm . | |
| D. 272,969 | 3/1984 | Sussman . | |
| 605,510 | 6/1898 | Patchett . | |
| 722,624 | 3/1903 | Pickop . | |
| 755,311 | 3/1904 | Palmer . | |
| 834,928 | 11/1906 | Neilson . | |
| 887,548 | 5/1908 | Trumble | 16/382 |
| 890,471 | 6/1908 | Taylor . | |
| 959,099 | 5/1910 | Anderson . | |
| 1,659,305 | 2/1928 | Vance . | |
| 1,835,042 | 12/1931 | Hammer . | |
| 2,466,848 | 4/1949 | Hausner . | |
| 4,239,310 | 12/1980 | Benjamin . | |
| 4,610,489 | 9/1986 | Dibert, Jr. et al. . | |
| 4,888,854 | 12/1989 | Russell et al. . | |
| 4,973,110 | 11/1990 | Nyquist . | |
| 5,038,437 | 8/1991 | Russell et al. . | |
| 5,063,638 | 11/1991 | Howard et al. . | |
| 5,139,322 | 8/1992 | Aisley . | |
| 5,356,027 | 10/1994 | Craft et al. . | |

FOREIGN PATENT DOCUMENTS

| | | | |
|---|---|---|---|
| 112484 | 11/1964 | Czech Rep. | 16/382 |
| 1516974 | 3/1968 | France . | |
| 0556821 | 3/1993 | Japan . | |
| 6133825 | 5/1994 | Japan . | |
| 13751 | 6/1911 | United Kingdom | 16/270 |

*Primary Examiner*—Peter M. Cuomo
*Assistant Examiner*—Gerald A. Anderson
*Attorney, Agent, or Firm*—Wood, Herron & Evans

[57] ABSTRACT

A door and hinge apparatus allowing quick connection and disconnection with respect to a frame, such as a cabinet frame. The door includes at least two generally elliptical slots. The generally elliptical slots have an enlarged opening and a narrower slot portion located above the enlarged opening. Mounting posts having enlarged heads protrude from one hinge leaf. The door attaches by placing the enlarged openings over the enlarged heads and sliding the door to engage the narrow slot portions with the enlarged heads. An aperture in the second hinge leaf aligns with an aperture associated with the door, and a locking plug is inserted through both apertures to prevent the door from sliding off the mounting posts.

13 Claims, 1 Drawing Sheet

QUICK CONNECT AND DISCONNECT DOOR AND HINGE APPARATUS

FIELD OF THE INVENTION

The present invention relates to a door and associated hinge apparatus allowing a quick connection and disconnection between the door and another structure. More particularly, the invention relates to such a door and hinge apparatus used on cabinet structures.

BACKGROUND OF THE INVENTION

The exterior surface of cabinet doors, for example, may have a variety of ornamental features to provide an aesthetically pleasing cabinet. For example, the exterior surface of the door may consist of wood, metal, or plastic panelling or trim. Alternatively, the cabinet door exterior may have a painted or stenciled design. In the case of a bathroom medicine cabinet, the exterior surface usually consists of a mirror.

Although cabinets of the above described type are generally well known, the relatively permanent attachment between the body and the door of the cabinet results in several limitations and disadvantages. First, cabinet manufacturers, wholesalers and retailers must stock entire cabinet assemblies. Due to the wide variety of cabinet sizes and styles desired by consumers, a great number of entire cabinet assemblies must be stocked, requiring large amounts of warehouse and storage space. From the consumer's standpoint, replacing the entire cabinet assembly can be quite expensive and labor intensive. In this latter regard, removal of the old cabinet and installation of the new cabinet normally requires tools such as drills, screwdrivers, etc.

Cabinet doors may be replaced by removing the screws holding the door to the hinge and replacing the old door with a new door. This conventional method of door replacement, however, also has several disadvantages. First, the new replacement door may not easily attach to the cabinet hinge assembly. Due to the wide variety of hinges and doors available, the new points of attachment may not align with the previous points of attachment. Thus, the installer may have to drill new holes in the cabinet assembly to attach the new door. Installation again requires several tools such as screwdrivers, drills, and wrenches.

Several hinge assembly devices have been proposed in the past to address some of the problems mentioned above. U.S. Pat. No. 722,624, issued to Pickop, discloses a detachable hinge having a leaf with a keyholed slot. The hinge mounts on a door frame having a stud with an enlarged head. This hinge assembly, however, fails to provide any means for preventing the hinge from being accidentally lifted off the door frame.

U.S. Pat. No. 188,402, issued to Palm, discloses a detachable door and hinge assembly having two locking posts extending from one leaf of the hinge. These locking posts slidably engage two keyhole slots contained in locking plate recessed into a door frame. A pivoting locking plate prevents the door from being lifted off the frame. The door and hinge assembly disclosed in U.S. Pat. No. 188,402, however, requires tools to mount the hinge and the locking plates. U.S. Pat. No. 1,835,042 issued to Hammer discloses a bathroom cabinet door assembly that provides for removable attachment of the door to the cabinet structure. This assembly, however, also requires tools to assemble the door to the hinge structure.

In view of the above disadvantages in this art, it would be desirable to provide a structure, such as a cabinet, having a simplified door and hinge system that can be originally manufactured or removed and replaced as an after market item without the need for tools. It would also be desirable to provide a removable cabinet door having a means to prevent the door from being inadvertently lifted off the hinge assembly. Furthermore, it would be desirable to eliminate the need to stock numerous styles of cabinet assemblies and the related need of the consumer to replace whole cabinet assemblies during remodelling.

SUMMARY OF THE INVENTION

The present invention generally provides a hinge and door apparatus which allows a door to be quickly and easily mounted to a door frame and locked in place without the use of tools. The hinge includes first and second pivotally connected leaves. A plurality of spaced mounting posts project outwardly from the second leaf with each of the mounting posts being formed with an enlarged head portion. The second leaf further includes at least one aperture for receiving a locking plug as will be described below. One edge of the door has a plurality of generally elliptical slots having an enlarged opening for receiving the enlarged heads of the mounting posts and a slot portion dimensioned smaller than the enlarged heads. This edge of the door further includes an aperture that aligns with the aperture in the second hinge leaf when the door is attached to the hinge. The door is easily connected to the hinge by engaging the enlarged openings of the generally elliptical slots with the mounting posts and sliding the door onto the hinge to engage the slot portions with the enlarged heads. This aligns the two apertures in the hinge and the door and a locking plug is finally inserted through these apertures to lock the door in place.

The generally elliptical slots and the aperture associated with the door are preferably spaced along an inner surface of the door. These slots and the aperture may be contained directly in the door itself or on a separate plate attached to the inside surface of the door. In this latter embodiment, the generally elliptical slots do not have to be milled into the door. In either case, the generally elliptical slots are preferably contained in an area of the door back embossed off the inner surface of the door. The enlarged head of each mounting post may therefore fit between the embossed area and the inner surface of the door when the door is mounted to the hinge. Most preferably, the door includes a plurality of embossed areas with each embossed area including an elliptical slot.

One application for the present invention is in the area of cabinetry. Specifically, the present invention contemplates the use of the above-described hinge and door apparatus on an otherwise conventional cabinet structure. The hinge may be formed as one continuous hinge which is mounted along a front edge or frame portion of the cabinet. Alternatively, separate hinges may be disposed along the edge of the cabinet with one or more of the hinges including a mounting post and an aperture for respectively registering with a generally elliptical slot and aperture associated with the cabinet door.

Several important advantages of the present invention will be appreciated from the foregoing summary. The invention first provides a cabinet having a quick connect and disconnect hinge and door mechanism that can be installed without tools. The invention further allows a cabinet design to be changed quickly and easily. As a result, this reduces the number of whole cabinet structures that must be manufactured and stocked.

While some of the main advantages have been mentioned above, those of ordinary skill in the art will readily recognize many more of the advantages and objectives of this invention upon reviewing the following detailed description of the preferred embodiment taken in conjunction with the accompanying drawings.

DETAILED DESCRIPTION OF SPECIFIC EMBODIMENTS

Figure 1:
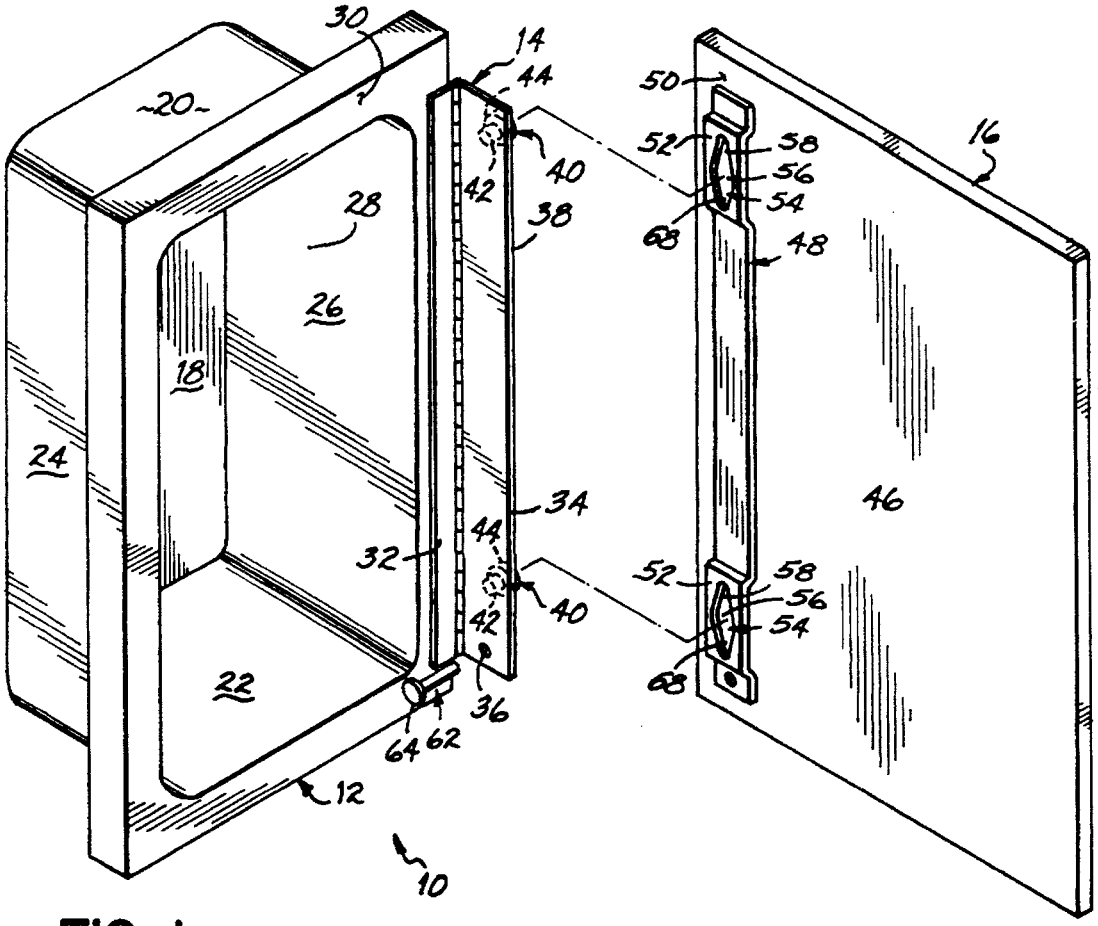
FIG. 1 is a perspective view illustrating a cabinet having a quick connect and disconnect door and hinge apparatus in accordance with an embodiment of the present invention.

Referring first to FIG. 1, a cabinet 10 is shown in accordance with a preferred embodiment of the invention to include a housing 12 attached to a hinge 14 and a door 16 which can be removably mounted to the hinge 14. In accordance with the present invention, the cabinet 10 preferably surface mounts to an interior wall, such as in a kitchen or a bathroom. The cabinet 10 could attach to a recess contained in an interior wall of a building, such as in the case of a bathroom medicine cabinet. The housing 12 includes a rear wall 18 connected to a top wall 20, a bottom wall 22, and two side walls 24 and 26. The top wall 20, bottom wall 22, and two side walls 24 and 26 forwardly project from the rear wall, defining a forwardly open interior compartment 28. The housing 12 also includes a forward edge 30 which is essentially a door frame.

The hinge 14 includes a first leaf 32 pivotally connected to a second leaf 34. The first leaf 32 is mounted along the forward edge 30 of the housing 12. The second leaf 34 has at least one aperture 36 therein, and the second leaf 34 further has an outer face 38.

At least two mounting posts 40 project from the outer face 38. The mounting posts 40 are longitudinally spaced along the outer face 38 of the second leaf 34. Each of the mounting posts 40 has a body portion 42 and an enlarged head 44. The size of the mounting posts 40 is exaggerated in FIG. 1 to illustrate the enlarged head 44 of each mounting post 40. A person of ordinary skill in the art will be able to select the appropriate size for the mounting posts 40, depending on the size of the cabinet and hinge used for a particular application.

The door 16 includes an inner surface 46 having an embossed area 52. In one preferred embodiment, the embossed area 52 can be part of a mounting plate 48 that is mounted to the inner surface 46 of the door 16. Alternatively, the embossed area 52 may be contained along a side edge 50 of the inner surface 46 of the door 16. The embossed area 52 also has at least two generally elliptical slots 54.

Figure 2:
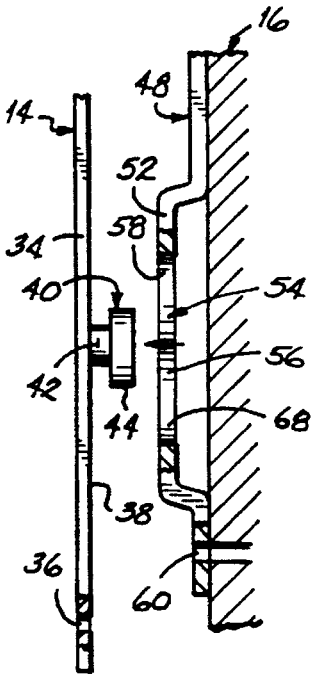
FIG. 2 is a fragmented cross-sectional view illustrating the alignment of a mounting post with a generally elliptical slot as well as alignment of the locking plug apertures during assembly of the door to the cabinet.

Each of the generally elliptical slots 54 has an enlarged opening 56 sized to fit over the enlarged heads 44 of the mounting posts 40. A first slot portion 58 longitudinally extends above the enlarged opening 56 on each of the generally elliptical slots 54. As shown in FIG. 2, the first slot portion 58 is dimensionally smaller or narrower than the diameter of the enlarged head 44 of the mounting post 40.

The generally elliptical slots 54 are spaced in manner to receive the mounting posts 40 on the second leaf 34 of the hinge 14. The mounting plate 48 also has an aperture 60 therein. A locking plug 62 is provided to be inserted through the respective apertures 36 and 60. Alternatively, the generally elliptical slots 54 and the aperture 60 may be contained within the inner surface 46 of the door 16.

Figure 3:
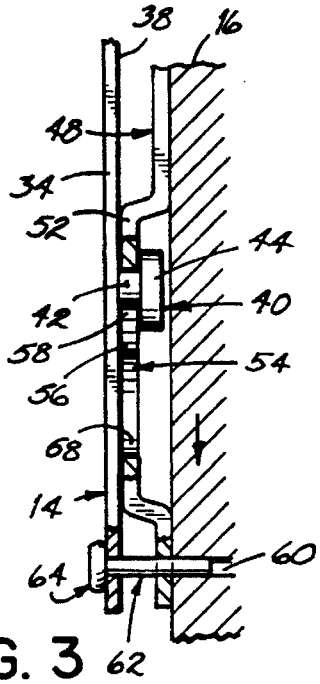
FIG. 3 is a cross-sectional view similar to FIG. 2 illustrating the assembled state of the hinge and door.

The operation and advantages of the present invention will be appreciated with reference to FIGS. 1–3. FIG. 1 shows the door 16 detached from the housing 12. The door 16 attaches to the housing 12 by positioning the enlarged openings 56 of the generally elliptical slots 54 over the enlarged heads 44 of the mounting posts 40. FIG. 2 shows a detached view of an enlarged opening 56 aligned to receive an enlarged head 44 of one of the mounting posts 40.

The door 16 is placed in a locked position by sliding the door 16 so that the enlarged heads 44 engage with the first slot portions 58 of the generally elliptical slots 54, as shown in FIG. 3. The enlarged head 44 of each mounting post 40 firmly holds the door 16 to the second leaf 34 of the hinge 14.

Sliding the enlarged heads 44 into engagement with the first slot portions 58 causes the aperture 36 on the second leaf 34 to align with the aperture 60 on the mounting plate 48 of the door 16. The door 16 is prevented from sliding off the mounting posts 40 by inserting the locking plug 62 in the aligned apertures 36 and 60. The locking plug 62 is sized to snugly fit in apertures 36 and 60, and the plug has a flat head 64 so as not to interfere with the operation of the hinge 14 when the door is closed.

According to the present invention, the door 16 can be disassembled from the housing 12 by reversing the steps for assembly described above. Specifically, the locking plug 62 is removed from apertures 36 and 60. The door 16 is moved to the unlocked position by sliding the door upwardly to disengage the first slot portions 58 from the enlarged heads 44 as shown in FIG. 2. Once the door 16 is in the unlocked position with enlarged openings 56 positioned over the enlarged heads 44, the door 16 is removed from the mounting posts 40 by pulling the door away from the second leaf 34 of a hinge 14.

Figure 4:
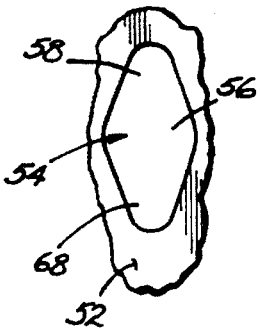
FIG. 4 is a fragmented front view illustrating a generally elliptical slot having an enlarged opening and two opposing, smaller slot portions.

Referring now to FIG. 4, each generally elliptical slot 54 preferably includes a second slot portion 68 opposite to the first slot portion 58. The second slot portion 68 is also dimensionally smaller than the enlarged heads 44 of the mounting posts 40. With each of the generally elliptical slots 54 having the first and the second slot portions 58 and 68, the door 16 can be attached to either side of the housing 12. More specifically, with reference to FIGS. 1 and 4, a door having opposed first and second slot portions 58 and 68 can be mounted as shown in FIG. 1, with the hinge assembly mounted along the forward edge 30 of the sidewall 26. Alternatively, the hinge could be mounted along the forward edge 30 of sidewall 24, the door could be rotated 180° about its planar surface and mounted along sidewall 24.

While the present invention has been illustrated by a description of various embodiments and while these embodiments have been described in considerable detail, additional advantages and modifications will readily appear to those skilled in the art. Accordingly, departures may be made from such details without departing from the spirit or scope of applicant's general inventive concept.

In addition to the various alternatives mentioned above, for example, more than one locking plug and pair of aligned apertures can be used to prevent the door from sliding off of the mounting posts. Instead of having a plurality of mounting posts projecting from the second hinge leaf of a single hinge assembly, a plurality of hinges could be used, with each hinge having a mounting post protruding the second hinge leaf. Also, the slot portions may be keyhole shaped instead of being generally elliptical in shape. Furthermore, the configuration of the cabinet may be modified so that the door is mounted on either side of the cabinet or along the top or bottom edge, while still retaining the inventive concepts of the invention.

The invention in its broader aspects is therefore not limited to the specific details and illustrative example shown and described. The scope of the invention, therefore, is only to be bound by the scope of the appended claims.

What is claimed is:

1. A hinge and door apparatus comprising:

a first hinge leaf adapted to be mounted along a door frame;

a second hinge leaf pivotally connected to said first leaf, said second leaf having at least one aperture therein;

at least one mounting post projecting from an outer face of the second leaf, said mounting post having an enlarged head;

a door having an aperture and at least one slot along one edge thereof, said slot having an enlarged opening for receiving said enlarged head and a first slot portion dimensioned smaller than said enlarged head; and a locking plug adapted to be inserted through the respective apertures in the second leaf and the door;

whereby the door is removably mounted to the second leaf by engaging the enlarged head with the enlarged opening and sliding the door to engage the first slot portion with the enlarged head and align the aperture in the second leaf with the aperture of the door thereby allowing insertion of the locking plug through the aligned apertures to prevent the door from sliding off the mounting post.

2. The apparatus claimed in claim 1 wherein the slot and the aperture of said door are spaced along an embossment on an inner surface of said door.

3. The apparatus claimed in claim 1 wherein an inner surface of said door further includes a mounting plate and said slot and said aperture of the door are contained in said mounting plate.

4. The apparatus claimed in claim 3, said mounting plate further having an embossed area raised off the inner surface of said door, said raised portion containing said slot.

5. The apparatus claimed in claim 1 wherein said slot further has a second slot portion extending in a direction opposite from said first slot portion, said second slot portion dimensioned smaller than said enlarged head.

6. The apparatus claimed in claim 1 further comprising:

a plurality of said mounting posts longitudinally spaced and projecting from said outer face of the second leaf; and a plurality of said slots along said one edge of the door, said slots spaced in a manner to receive said mounting posts.

7. A cabinet apparatus comprising:

a housing including a rear wall connected to a forwardly projecting top wall, a bottom wall and a pair of side walls to define a forwardly open interior compartment;

at least one hinge having a first leaf adapted to be mounted along a forward edge of said compartment and a second leaf pivotally connected to said first leaf, said second leaf having at least one aperture therein, at least one mounting post projecting from an outer face of the second leaf, said mounting post having an enlarged head;

a door having an aperture and at least one slot along one edge thereof, said slot having an enlarged opening for receiving said enlarged head and a first slot portion dimensioned smaller than said enlarged head; and a locking plug adapted to be inserted through the respective apertures in the second leaf and the door;

whereby the door is removably mounted to the second leaf by engaging the enlarged head with the enlarged opening and sliding the door to engage the first slot portion with the enlarged head and align the aperture in the second leaf with the aperture of the door thereby allowing insertion of the locking plug through the aligned apertures to prevent the door from sliding off the mounting post.

8. The apparatus claimed in claim 7 wherein the slot and the aperture of said door are spaced along an embossment on an inner surface of said door.

9. The apparatus claimed in claim 7 wherein an inner surface of said door further includes a mounting plate, wherein said slot and said aperture of the door are contained in said mounting plate.

10. The apparatus claimed in claim 9, said mounting plate further having an embossed area raised off the inner surface of said door, said raised portion containing said slot.

11. The apparatus claimed in claim 7 wherein said slot further has a second slot portion extending in a direction opposite from said first slot portion, said second slot portion dimensioned smaller than said enlarged head.

12. The cabinet claimed in claim 7 wherein said first leaf and said second leaf longitudinally extend along the entire length of said forward edge.

13. The apparatus claimed in claim 12 further comprising:

a plurality of said mounting posts longitudinally spaced and projecting from said outer face of the second leaf; and a plurality of said slots along said one edge of the door, said slots spaced in a manner to receive said mounting posts.

* * * * *